United States Patent [19]

Bourgie

[11] Patent Number: 4,625,188

[45] Date of Patent: Nov. 25, 1986

[54] PIVOTING JOINT FOR ULTRA-HIGH FREQUENCY WAVEGUIDES

[75] Inventor: Paul Bourgie, Paris, France

[73] Assignee: Thomson CSF., Paris, France

[21] Appl. No.: 744,663

[22] Filed: Jun. 14, 1985

Related U.S. Application Data

[63] Continuation of Ser. No. 468,595, Feb. 22, 1983, abandoned.

[30] Foreign Application Priority Data

Mar. 5, 1982 [FR] France ..... 82 03732

[51] Int. Cl.[4] ..... H01P 1/06

[52] U.S. Cl. ..... 333/257; 333/261; 343/DIG. 2

[58] Field of Search ..... 333/261, 257, 256, 260, 333/254, 249; 393/763, 762, 757, 705, 708, DIG. 2

[56] References Cited

U.S. PATENT DOCUMENTS

| | | | |
|---|---|---|---|
| 2,521,818 | 9/1950 | Aron et al. | 333/257 |
| 2,708,263 | 5/1955 | Walters | 333/257 |
| 2,768,358 | 10/1956 | Moseley et al. | 333/257 |
| 2,837,723 | 6/1958 | Krantz et al. | 333/256 |
| 2,969,513 | 1/1961 | Brennalt | 343/762 X |
| 3,155,923 | 11/1964 | Persson | 333/254 X |
| 3,412,404 | 11/1968 | Bergling | 343/762 |

FOREIGN PATENT DOCUMENTS

| | | | |
|---|---|---|---|
| 1065033 | 7/1958 | Fed. Rep. of Germany | 333/256 |
| 1209772 | 10/1969 | U.S.S.R. | 333/256 |

*Primary Examiner*—Eugene R. LaRoche
*Assistant Examiner*—Benny T. Lee
*Attorney, Agent, or Firm*—Cushman, Darby & Cushman

[57] ABSTRACT

A pivoting joint connects two rectangular waveguides, connecting transmission-reception equipment on board a satellite to an antenna, which is only opened out when the satellite has been placed in orbit. These waveguides comprise a fixed section and a moving section, pivoting about the longitudinal axis common to the two sections. They issue or open out in facing manner on two parallel planar faces separated by a non-zero distance, but which is very small compared with the wavelength. One of these faces has a quarter-wave trap ensuring the radio seal of the joint. An abutment defines the position in which the two guides are in an extension of one another. When the satellite reaches orbit, antenna is opened out and the joint pivots to this position.

3 Claims, 2 Drawing Figures

PIVOTING JOINT FOR ULTRA-HIGH FREQUENCY WAVEGUIDES

This is a continuation of application Ser. No. 468,595, filed 2-22-83, which was abandoned upon the filing hereof.

BACKGROUND OF THE INVENTION

The invention relates to a joint making it possible to connect two ultra-high frequency waveguides, having a rectangular section and a common longitudinal axis, and which are able to have a relative rotary movement about their commong longitudinal axis.

It is more particularly usable in the case of a connection of a pivoting antenna equipping a satellite. Such an antenna has two positions, namely a first position in which it is bent back against the satellite in order that it can be held in the volume defined by the cover protecting the satellite during its launch, and a second or operating position, when it is opened out after the satellite has reached orbit. The rotation angle is then below 360° and the second position is fixed.

The antenna is connected by two waveguide sections to transmission or reception equipment on board the satellite. One section is integral with the antenna and the other section is integral with the satellite. The junction between the fixed section and the moving section must be brought about by a device which does not attenuate the signal and which is reliable in a temperature range from −150° to +200° C., in the presence of radiation.

It is known to use a flexible waveguide, but the greater the rotation angle, the longer said guide. Its losses are by no means negligible and vary in a random manner as a function of the conformation taken by the guide after the opening out of the antenna. It is also known to bring about a connection by a flexible coaxial cable, but this leads to by no means negligible losses and its insulation finds it difficult to withstand extreme temperatures. These two devices require a relatively powerful motor and a certain energy consumption for opening out the antenna.

It is also known to construct joints, which rotate by more than 360°, by the contactless connection of two coaxial lines, whereby their outer conductors on the one hand and their inner conductors on the other face one another over a length equal to quarter the wavelength. This device has a complicated and costly construction when losses must be minimized.

Finally it is known to bring about a change in the propagation mode of the waves for passing them from a guide having a rectangular section to a guide with a circular section by providing a rotary joint on said circular guide and then again changing the mode in order to again pass the waves into a rectangular guide. The disadvantage of this device is that is requires two mode changes, so that the resulting losses are not neglibible.

BRIEF SUMMARY OF THE INVENTION

The device according to the invention obviates these disadvantages by simple means.

The present invention therefore specifically relates to a pivoting joint for ultra-high frequency waveguides having a rectangular cross-section, for connecting a first fixed waveguide to a second waveguide having a common longitudinal axis with the first guide and pivoting about the said axis, wherein said joint comprises a first member integral with one of the two guides, and a second member integral with the other guide, said two members each having a planar face perpendicular to the longitudinal axis of the two guides, said faces being separated by a space having a non-zero dimension which is well below the wavelength of the guided waves, the guides respectively issuing on to these two faces, at least one quater-wave trap made in one of the planar faces and surrounding the guide issuing on to said face, and an abutment for stopping the pivoting of the second guide when it has reached a position where it is in the extension of the first guide.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
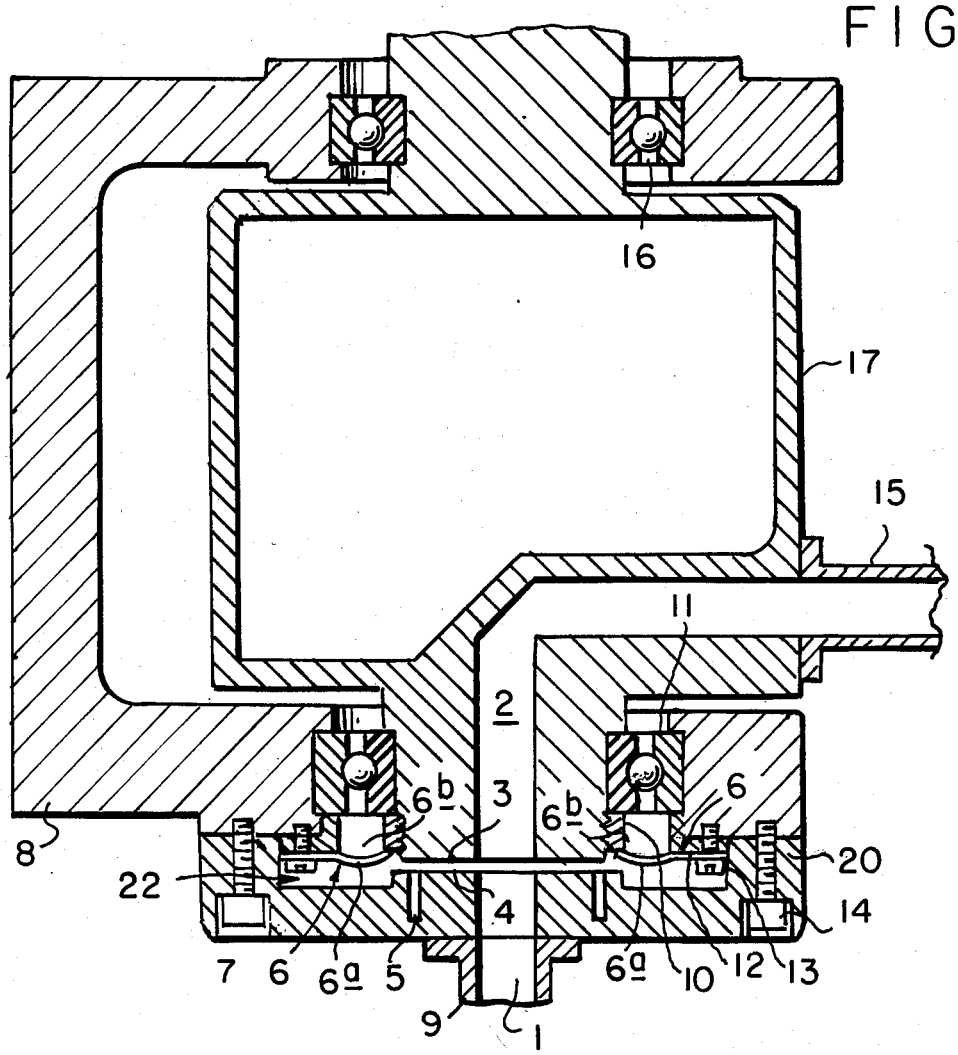
FIG. 1 a section through an embodiment of the joint according to the invention.

In FIG. 1, a waveguide tube cross-section 9 having a rectangular section, connects the transmission or reception equipment to the joint according to the invention and a waveguide tube section 15, having a rectangular section, connects the joint to the antenna. The joint essentially comprises a fixed frame 8 integral with the satellite and a member 17 integral with the antenna and the waveguide tube section 15. Member 17 can rotate relative to frame 8 by means of two ball bearings 11, 16, having the same axis of revolution coinciding with the longitudinal axis of the waveguide tube section 9. The rotation of member 17 and of the antenna is ensured by a motor, or a spring, not shown in the drawing. The two positions of the antenna are defined by abutments, which are not shown. Member 17 has a planar face 3, perpendicular to the rotation axis, on to which issues a rectangular waveguide 2. At said end of waveguide 2, its longitudinal axis coincides with the rotation axis of member 17. Waveguide 2 is inserted in member 17 and, following a 90° bend, opens out in front of the waveguide tube section 15 which, in the present embodiment, is perpendicular to the rotation axis of member 17.

The joint according to the invention also comprises a member 7, to which is connected the end of the waveguide tube section 9. Member 7 including a flange 20 which is fixed by four screws 14 to frame 8. Member 7 also has a central planar face 4 perpendicular to the rotation axis and facing the planar face 3 of member 17. A waveguide 1 is inserted in member 7, in the extension of the waveguide tube 9 and opens out on to the planar face of member 7. When the antenna is placed in its operating position, member 17 assumes a position such that waveguide 2 is in the extension of waveguide 1 and waveguide 9.

A quater-wave trap 5 is formed on the planar face 4 of member 7 in circular manner around the hole at which waveguide 1 issues, the revolution symmetry axis of trap 5 coinciding with the rotation axis. From a radio frequency standpoint, a quater-wave trap ensures the seal between the junction of two waveguide tubes. For example, for connecting two fixed waveguide tubes, the end of each tube is provided with a planar flange perpendicular to the longitudinal axis of the two tubes. The flanges of the two tubes to be connected are engaged with one another by four clamping screws. A quarter-wave trap is formed by a rectangular groove, whose depth is equal to a quarter wavelength and which is hollowed out from one of the flanges on the planar face in contact with the other flange. This groove is circular and passes around the hole at which the waveguide issues. If the waveguide has a rectangular section, the maximum distance between the groove and the walls of the guide is chosen to be equal to a quarter wavelength. Thus, the junction between the two flanges behaves like a short-circuit, even if the two flanges are not completely contiguous.

Figure 2:
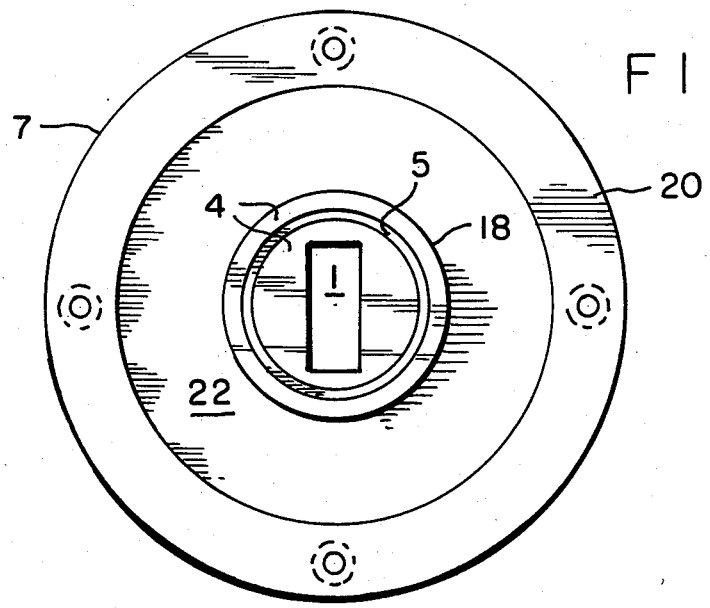
FIG. 2 a view of the members constituting said embodiment.

FIG. 2 is a plan view of member 7. In the present embodiment, wavelength is approximately 3 cm, the section of the waveguide 1 is 22.86 mm×10.16 mm, the internal diameter of the quarter-wave trap 29.26 mm, its external diameter 32.86 mm and its depth 9.10 mm. The planar face 4 of member 7 facing the planar face of member 17 is defined by a cylindrical edge 18 of diameter 40 mm, whose longitudinal axis coincides with the rotation axis. An annular space 22 is also defined between cylindrical edge 18 and flange 20. The space between the two facing faces 4, 3 of members 7 and 17, respectively, has a width of 0.05 mm, which permits their relative rotation without any rubbing together thereof. The absence of friction reduces the amount of energy required for the opening out of the antenna and obviates problems due to expansion as a function of temperature.

Ball bearing 11 is fixed on the one hand to member 17 by a locking collar 10, screwed on to a thread, and on the other to frame 8 by a collar 12 secured by four screws 13. Collars 10 and 12 have a revolution symmetry axis coinciding with the rotation axis.

A variant of the joint according to the invention comprises a diaphragm 6 for perfecting the radio seal of the joint, which is already ensured by the quarter-wave trap 5. Diaphragm 6 is planar except for the convexly-curved inner portion 6*a* which is provided to increase the elasticity of diaphragm 6. It also has a annular opening 6*b* concentric to the convexly-curved inner portion 6*a* which preferably has a diameter of 37 mm. The center of the convex ring and the opening is located on the rotation axis. The revolution symmetry axis of diaphragm 6 coincides with the rotation axis. The edge of the circular opening bears against and rubs on collar 10, whilst the periphery of diaphragm 6 is fixed to collar 12 by four screws 13. Thus, diaphragm 6 is integral with frame 8 and member 7.

The invention is not limited to the embodiment described and shown. Thus, it falls within the scope of these skilled persons to form a waveguide 2 extended beyond ball bearing 16, with or without a 90° bend. It is also possible for him to provide a quarter-wave trap on each of the two planar facing faces or to give said trap some other shape.

What is claimed is:

1. A pivoting joint joining rectangular ultra-high frequency waveguides through which ultra-high frequency radiation is guided, said joint comprising:

first and second rectangular waveguides;

a fixed-position frame establishing a frame axis;

connecting means for operatively interconnecting said first and second waveguides, said connecting means including (a) means defining an interconnecting waveguide of rectangular cross-section having first and second ends, (b) a planar face defined adjacent to said first end of said interconnecting waveguide perpendicular to said frame axis, said second end being aligned with and fixed to said second waveguide;

coupling means fixed to said frame in coaxial relationship to said frame axis, said coupling means including means defining an annular space to establish a central planar face in confronting, spaced-apart relationship to said first-mentioned planar face of said connecting means to define therewith a separation space, and an intermediate rectangular waveguide having one end which communicates with said first end of said interconnecting waveguide and another end which communicates with said first waveguide such that the cross-section of said intermediate waveguide at said another end is aligned with the cross-section of said first waveguide;

said connecting means also including means for pivotally mounting said connecting means to said frame for pivotal movements about said frame axis between (i) a stowed position wherein the cross-section of said interconnecting waveguide at its first end is misaligned with the cross-section of said intermediate waveguide at its one end and wherein the cross-section of said interconnecting waveguide at its second end remains aligned with the cross-section of said second waveguide, respectively, and (ii) an operative position wherein the cross-section of said interconnecting waveguide at its first and second ends is aligned with the cross-section of said intermediate waveguide at its one end;

sealing means to seal said coupling means against radiation losses through said separation space, said sealing means including (i) at least one quarter-wave trap defined in said central planar face and surrounding said one end of said intermediate waveguide, and (ii) annular diaphragm means fixed to said frame and coaxial to said frame axis in opposing relationship to said annular space for perfecting, with said trap, sealing of said joint; and wherein said diaphragm means is an annular ring having a planar outer portion and a convexly-curved inner portion.

2. A pivoting joint joining rectangular ultra-high frequency waveguides through which ultra-high frequency radiation is guided, said joint comprising:

first and second rectangular waveguides;

a fixed-position frame establishing a frame axis;

connecting means for operatively interconnecting said first and second waveguides, said connecting means including (a) means defining an interconnecting waveguide of rectangular cross-section having first and second ends, and (b) a planar face defined adjacent said first end of said interconnecting waveguide perpendicular to said frame axis, said second end being aligned with and fixed to said second waveguide;

coupling means fixed to said frame in coaxial relationship to said frame axis for connecting said first waveguide to said frame, said coupling means including means defining an annular space to establish a central planar face in confronting, spaced-apart relationship to said first-mentioned planar face to define therewith a separation space, and an intermediate rectangular waveguide having one end which communicates with said first end of said interconnecting waveguide and another end which communicates with said first waveguide such that the cross-section of said intermediate waveguide at said another end is aligned with the cross-section of said first waveguide said connecting means also including means for pivotally mounting said connecting means to said frame for pivotal movements about said frame axis between (i) a stowed position wherein the cross-section of said interconnecting waveguide at its first end is misaligned with the cross-section of said intermediate waveguide at its one end and wherein the cross-section of said interconnecting waveguide at its second end remains aligned with the cross-section of said second waveguide, respectively, and (ii) an operative position wherein the cross-section of said interconnecting waveguide at its first and second ends is aligned with the cross-section of said intermediate waveguide at its one end;

sealing means to seal said coupling means against losses of the guided radiation through said separation space, said sealing means including (i) at least one quarter-wave trap defined in said central planar and surroundng said intermediate waveguide, and (ii) annular diaphragm means fixed to said frame and coaxial to said pivot axis in opposing relationship to said annular space for perfecting, with said trap, sealing of said joint;

wherein said interconnecting waveguide establishes a 90° bend between said first and second waveguides.

3. A pivoting joint joining a pair of rectangular waveguides for guiding radiation from one of the waveguides to the other of the waveguides, said pivoting joint comprising:

first and second members each having a straight rectangular waveguide part connected to respective ones of said pair of waveguides, said first and second members being disposed end to end with their respective straight rectangular waveguide parts abutting along a common longitudinal axis, said members each having a planar end face which together establish a separation space therebetween and which surround a respective section of each said rectangular waveguide part, one of said planar end faces including a flange defining an annular space around said one planar end face which is in communication with said separation space;

pivoting means for coupling said first and second members to permit one member to be pivoted with respect to the other member about said longitudinal axis between (i) a stowed position wherein the cross-section of the straight rectangular waveguide part of said one member is misaligned with the cross-section of the straight rectangular waveguide part of said other member and (ii) an operative position wherein the cross-sections of the straight rectangular waveguide parts of said one and other members are aligned; and sealing means for sealing said separation space against losses of guided radiation, said sealing means including (i) at least one quarter wave trap defined in said one planar end face in opposing relationship to another planar end face and surrounding the section of said rectangular waveguide parts and (ii) annular diaphragm means disposed on said flange between said members for closing said annular space surrounding said separation space, wherein said diaphragm means is an annular ring having a planar outer portion and a convexly-curved inner portion.

* * * * *